US006544050B1

(12) United States Patent
Ko

(10) Patent No.: US 6,544,050 B1
(45) Date of Patent: Apr. 8, 2003

(54) ELECTRICAL CABLE CONNECTOR ASSEMBLY

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/071,552

(22) Filed: Feb. 8, 2002

(51) Int. Cl.[7] ..... H01R 13/648
(52) U.S. Cl. ..... 439/108; 439/497; 439/579
(58) Field of Search ..... 439/108, 607, 439/610, 493, 495, 497, 630, 636, 578, 579

(56) References Cited

U.S. PATENT DOCUMENTS 5,980,308 A * 11/1999 Hu et al. ..... 439/497
6,238,227 B1 * 5/2001 Wu et al. ..... 439/260
6,273,749 B1 * 8/2001 Yang ..... 439/497
6,273,753 B1 * 8/2001 Ko ..... 439/579

* cited by examiner

*Primary Examiner*—Hien Vu
(74) *Attorney, Agent, or Firm*—Wei Te Chung

(57) ABSTRACT

A cable connector assembly (100) includes a connector (90) and a coaxial cable subassembly (80). The coaxial cable subassembly has a plurality of wires (81), and a grounding bar (82) electrically contacting with braidings (811) of the wires. The connector includes a housing (10), an insert (20) defining a plurality of channels (201) for receiving contacts (30) and a slot (202) communicating with the channels for retaining the grounding bar, a shield (50) having a pair of tabs (53) extending therefrom, and a grounding plate (40) having two resilient pads (42). The two resilient pads are sandwiched between the tabs of the shield and the grounding bar to establish a grounding path.

12 Claims, 7 Drawing Sheets

ELECTRICAL CABLE CONNECTOR ASSEMBLY

BACKGROUND OF THE INVENTION

1. Field of the Invention

The present invention relates to an electrical cable connector assembly, and particularly to an electrical cable connector assembly having an improved grounding means.

2. Description of Prior Art

It is well known in the art that a grounding device is often used to reduce the crosstalk in an electrical connector, and particularly to reduce the crosstalk in an electrical connector terminating with a coaxial cable for transmitting data at a high speed. Such an electrical cable connector having a relevant grounding bus is disclosed in U.S. Pat. No. 4,781,620. The grounding bus has a base strip portion, and a plurality of axially rearwardly extending tab-like fingers arranged in a row extending widthwise of the cable and bent to juxtaposition with the bent bared portions of the coaxial shield. The grounding bus connects the braidings of the coaxial cable with the grounding contacts of the electrical connector so as to establish a grounding path therebetween for crosstalk prevention. However, soldering the grounding bus to the braidings decreases the assembly efficiency compared with a simple mechanical engagement therebetween. Meanwhile, the grounding bus and the grounding contacts are partially insert molded, which also complicates the manufacturing.

Hence, an electrical cable connector assembly having an improved grounding means is required to overcome the disadvantages of the prior art.

BRIEF SUMMARY OF THE INVENTION

A first object of the present invention is to provide an electrical cable connector assembly having an improved grounding means which simplifies the assembly process thereof.

A second object of the present invention is to provide an electrical cable connector assembly having an improved grounding means which ensures a reliable grounding path.

An electrical cable connector assembly in accordance with the present invention includes an electrical cable connector and a coaxial cable subassembly. The coaxial cable subassembly has a plurality of wires, and a grounding bar electrically contacting with braidings of the wires. The electrical cable connector includes an insulating housing, a dielectric insert defining a plurality of channels for receiving contacts therein and a lengthwise slot communicating with the channels for retaining the grounding bar, a shield having a pair of L-shaped tabs extending therefrom, and a grounding plate having two resilient pads. The two resilient pads are sandwiched between the tabs of the shield and the grounding bar to establish a grounding path.

Other objects, advantages and novel features of the invention will become more apparent from the following detailed description of the present embodiment when taken in conjunction with the accompanying drawings.

DETAILED DESCRIPTION OF THE INVENTION

Figure 1:
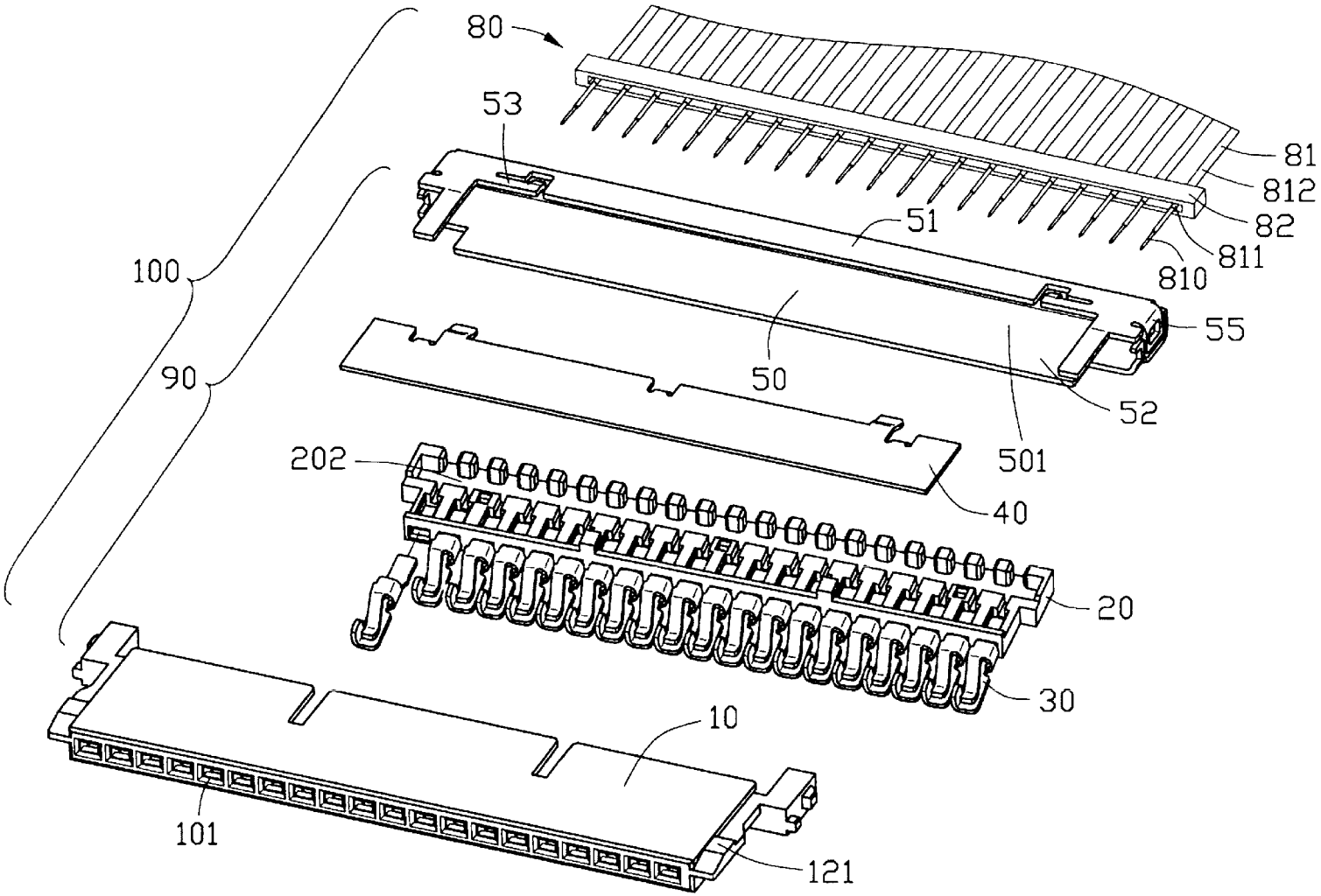
FIG. 1 is an exploded, perspective view of an electrical cable connector assembly with an improved grounding means in accordance with the present invention.

Referring to FIG. 1, an electrical cable connector assembly 100 in accordance with the present invention includes an electrical cable connector 90 and a coaxial cable subassembly 80. The electrical cable connector 90 comprises an insulating housing 10, a dielectric insert 20 receiving a plurality of contacts 30 therein, a grounding plate 40 for being assembled to the dielectric insert 20, and a conductive shield 50 for covering the insulating housing 10.

The coaxial cable subassembly 80 includes a plurality of wires 81 each having a core conductor 810, a metal braiding 811 wrapping round the core conductor 810, and an outer insulating jacket 812. Each wire 81 is stripped at a front end thereof to expose a length of the metal braiding 811 and a separate length of the core conductor 810. A grounding bar 82 electrically contacts with the metal braiding 81 1 to provide a grounding path.

Figure 2:
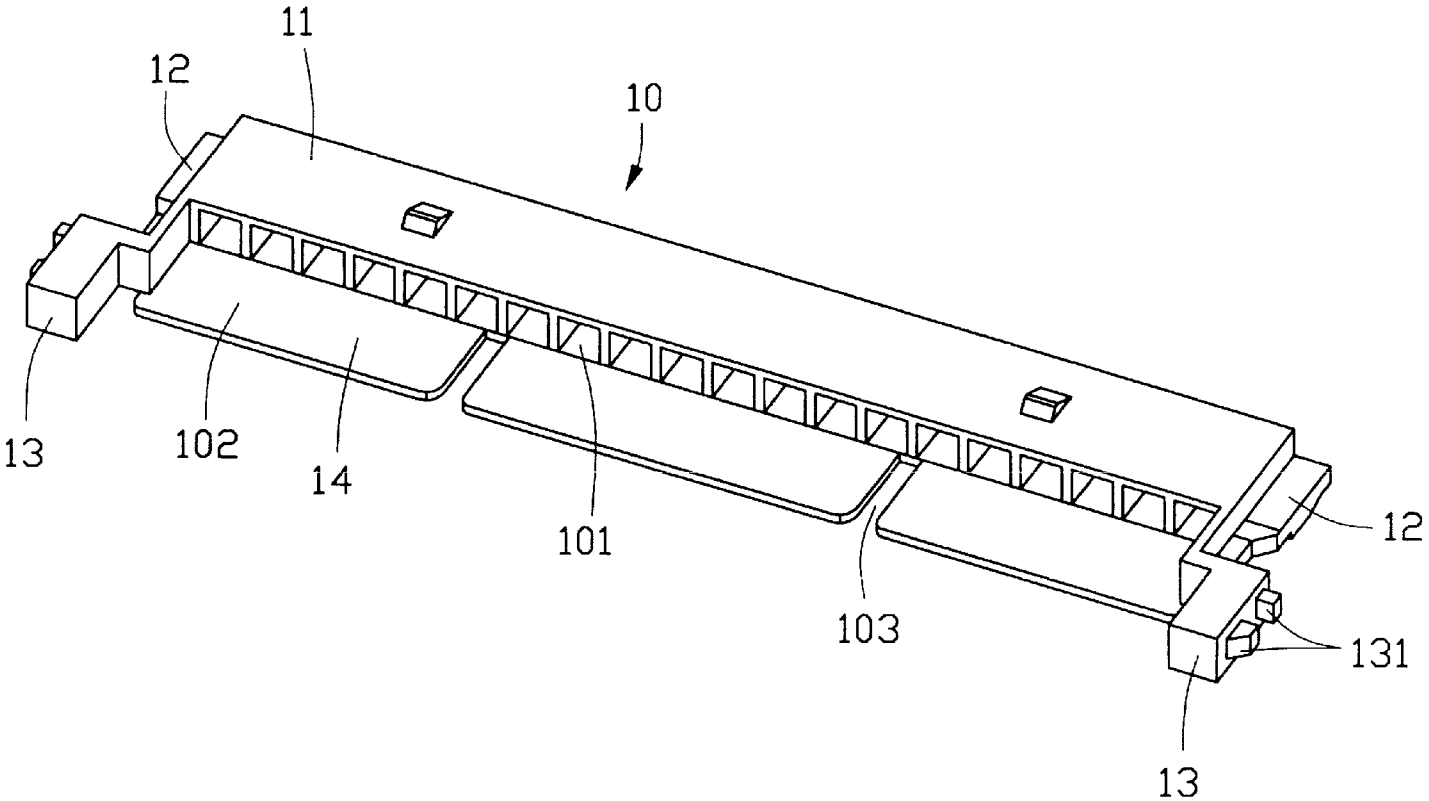
FIG. 2 is a bottom perspective view of an insulating housing of the electrical cable connector assembly shown in FIG. 1.

Referring to FIG. 2, the insulating housing 10 comprises an elongated main body 11 defining a plurality of passageways 101 therein to receive the contacts 30. A pair of flanges 12 projecting from opposite ends of the elongated main body 11 each has a block 121. Two arms 13 extend backwards from the opposite ends of the main body 11 and connect to rear ends of the flanges 12, and a tongue portion 14 extends rearwardly from an upper side of the housing 10, whereby a receiving space 102 is defined between the two arms 13 and the tongue portion 14 for receiving the dielectric insert 20. A plurality of protrusions 131 are formed on the arms 13 for engaging with corresponding parts of the shield 50. A pair of notches 103 are defined in the tongue portion 14 and open towards the rear.

Figure 3:
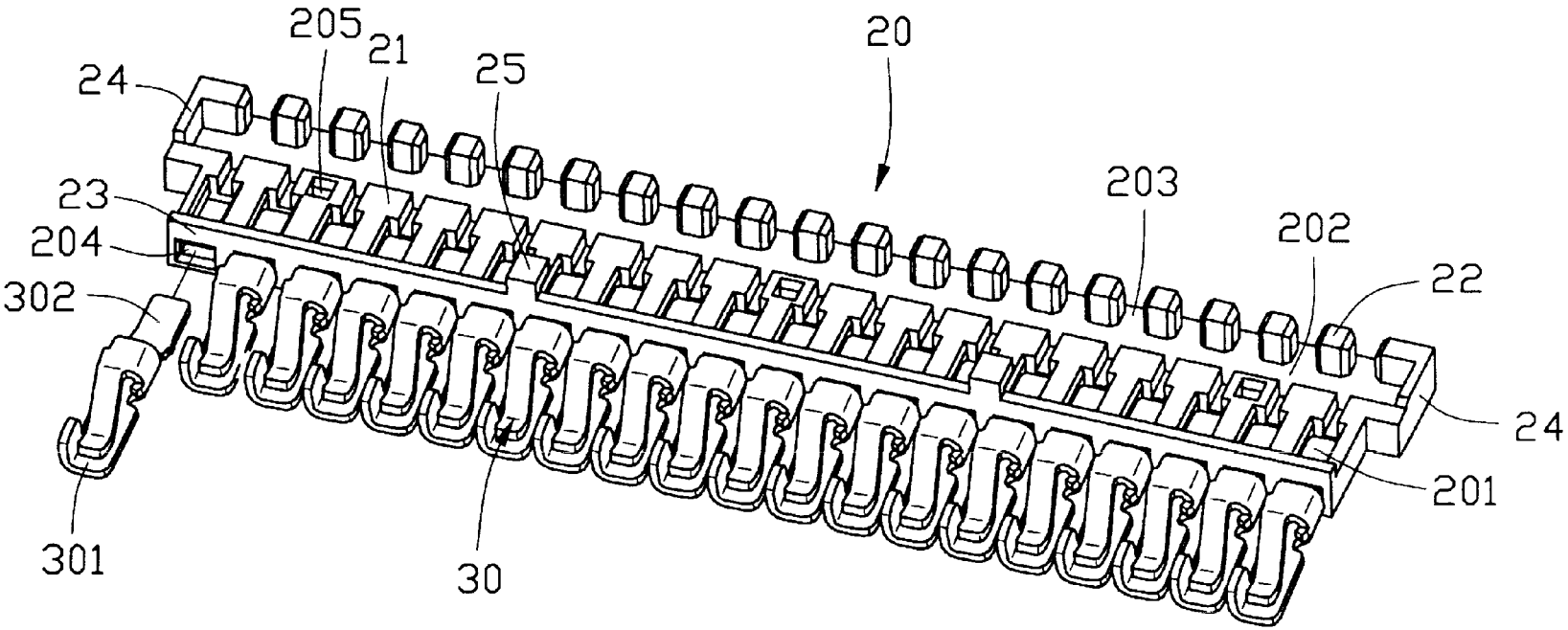
FIG. 3 is a perspective view of a dielectric insert of the electrical cable connector assembly shown in FIG. 1, with a plurality of contacts assembled thereto.

Referring to FIG. 3, the dielectric insert 20 comprises a row of T-shaped ribs 21 and a row of protrusions 22 on an upper side thereof, each protrusion 22 aligning with a corresponding T-shaped rib 21, whereby a receiving channel 201 is defined between adjacent ribs 21 and a recess 203 is defined between adjacent protrusions 22. An elongated slot 202 is defined lengthwise in the dielectric insert 20 for receiving the grounding bar 82 of the coaxial cable subassembly 80 and communicates the receiving channels 201 with the recesses 203. A rectangular plate 23 is formed at a front end of the dielectric insert 20 with a plurality of openings 204 defined therein in communication with the receiving channels 201. A pair of step-shaped side walls 24 are positioned at opposite ends of the dielectric insert 20 for preventing the grounding bar 82 from transversally moving in the elongated slot 202. Three cavities 205 are defined in top sides of three selected T-shaped ribs 21 of the dielectric insert 20. A pair of embossments 25 project from an upper side of the rectangular plate 23 for respectively engaging with the notches 103 of the insulating housing 10.

The contact 30 of the electrical cable connector 90 has a contacting portion 301 for electrical connection with terminals of a complementary connector (not shown), and a soldering portion 302 for soldering with the core conductor 810 of the wire 81 of the coaxial cable subassembly 80. The soldering portions 302 of the contacts 30 are received respectively in the receiving channels 201 through the openings 204, and the contacting portions 301 are forwardly exposed.

Figure 4:
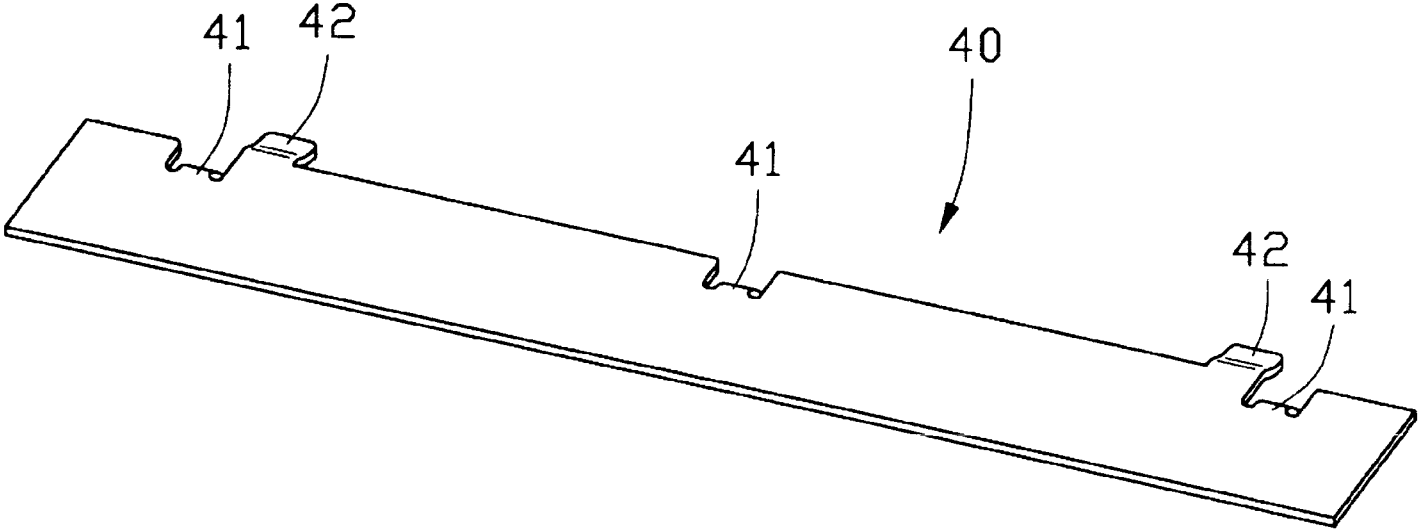
FIG. 4 is a perspective view of a grounding plate of the electrical cable connector assembly shown in FIG. 1.

Referring to FIG. 4, the grounding plate 40 provides three claws 41 projecting downwardly from a rear edge of the grounding plate 40 for being correspondingly received in the three cavities 205 of the dielectric insert 20 so as to fixedly attach the grounding plate 40 thereto. A pair of resilient pads 42 extend downwards and then upwards from the rear edge of the grounding plate 40 adjacent to opposite lateral edges for electrically contacting with the grounding bar 82 received in the elongated slot 202 of the dielectric insert 20.

Figure 5:
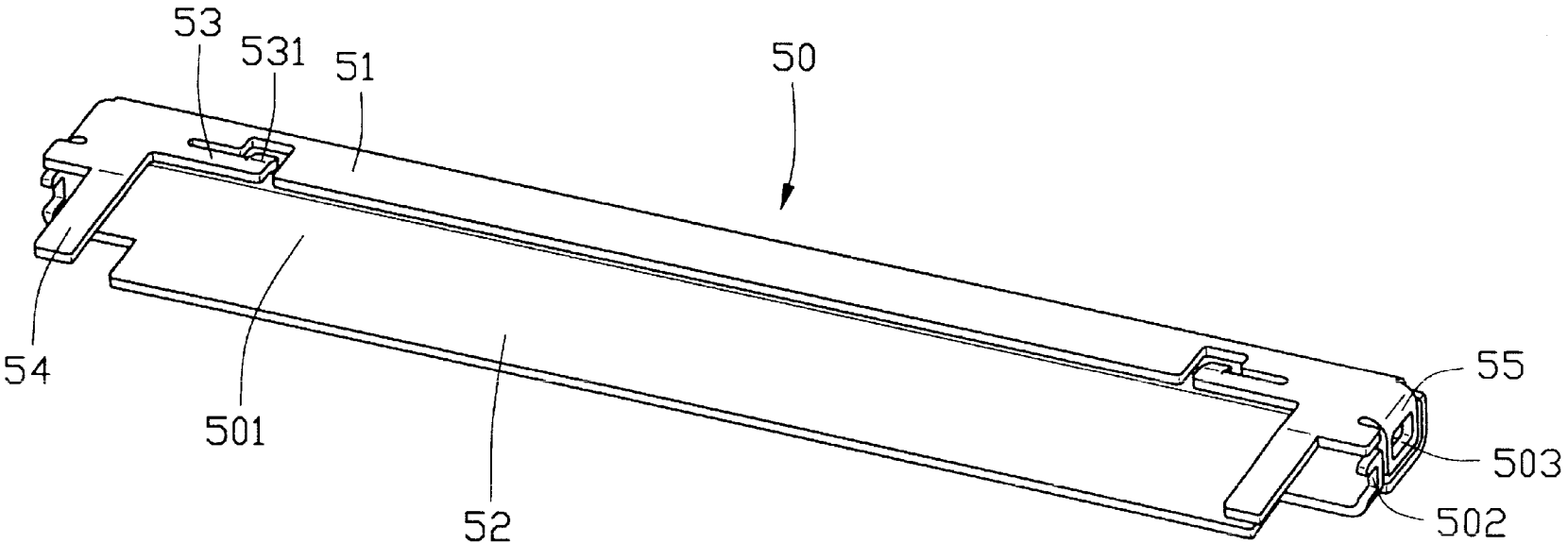
FIG. 5 is a perspective view of a shield of the electrical cable connector assembly shown in FIG. 1.

Referring to FIG. 5, the shield 50 has an upper plate 51, a lower plate 52, and opposite side plates 55 together defining a receiving space 501 therebetween for receiving the dielectric insert 20, the grounding plate 40 and the coaxial cable subassembly 80. A pair of L-shaped tabs 53 each having an inwardly extending free end 531 are formed at a front edge of the upper plate 51. Adjacent to the pair of L-shaped tabs 53, two fingers 54 extend forwardly from the front edge of the upper plate 51 for abutting against the blocks 121 of the flanges 12 of the insulating housing 10, respectively. A pair of cutouts 502 and a pair of rectangular holes 503 are defined separately in the opposite side plates 55 for engaging with corresponding protrusions 131 of the insulating housing 10 so as to latch the shield 50 on the insulating housing 10.

Figure 6:
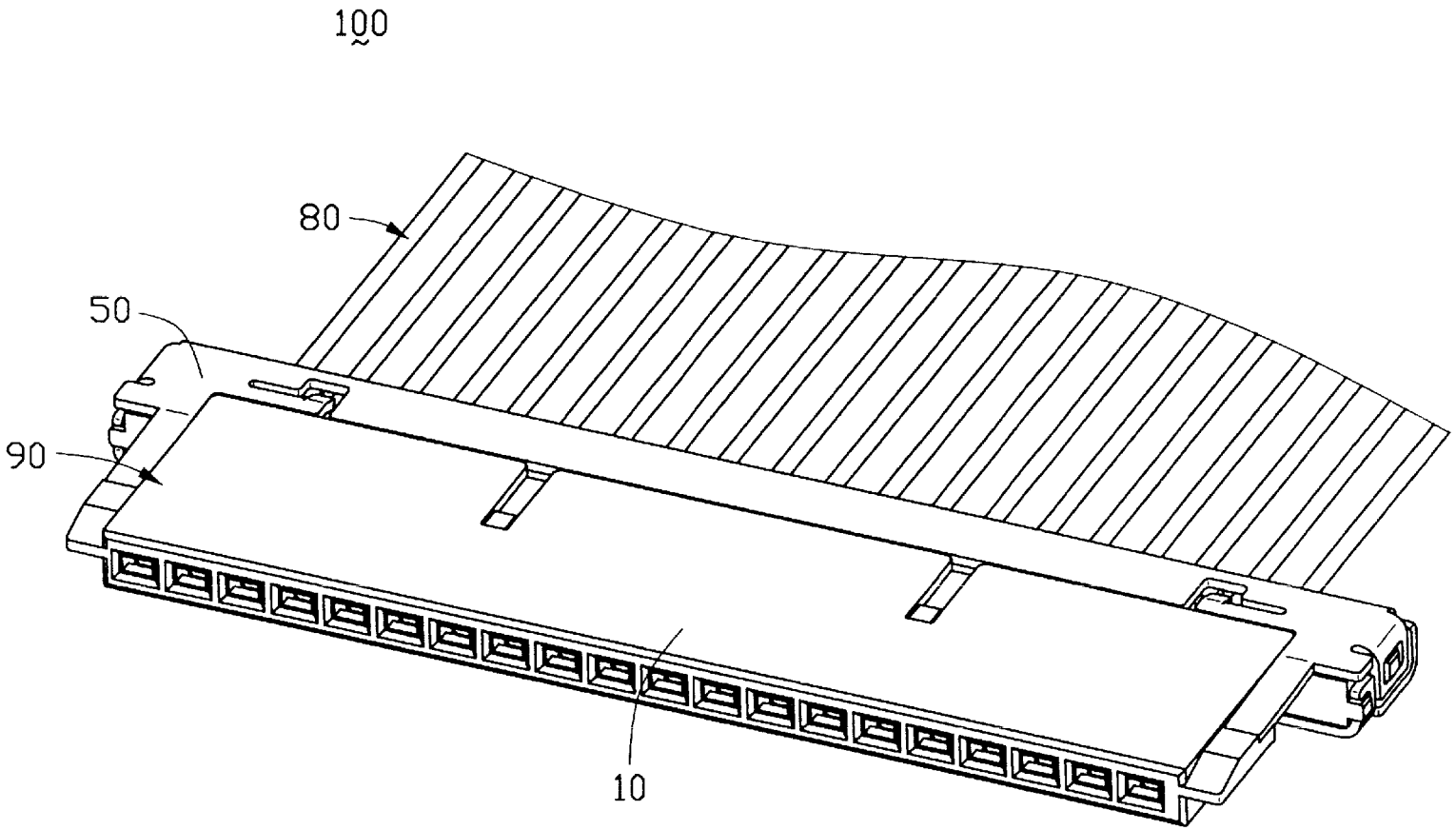
FIG. 6 is an assembled view of the electrical cable connector assembly shown in FIG. 1.
Figure 7:
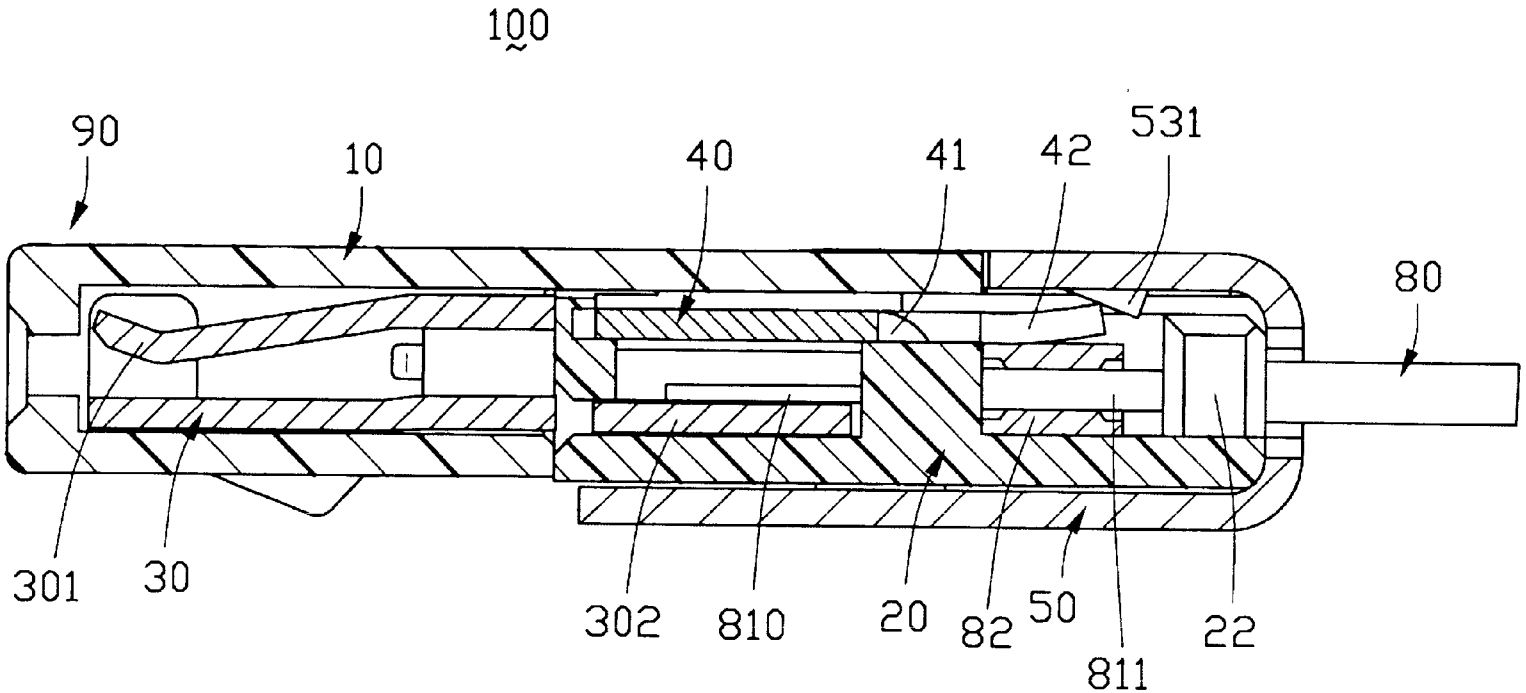
FIG. 7 is a cross-sectional view of the electrical cable connector assembly shown in FIG. 6.

Referring to FIGS. 6 and 7, in assembly, the coaxial cable subassembly 80 is attached to the dielectric insert 20 such that the grounding bar 82 is fixed in the elongated slot 202, and each core conductor 810 is received in the receiving channel 201 and soldered to the soldering portion 302 of a corresponding contact 30. Then, the grounding plate 40 is positioned above the insert 20 with the three claws 41 being held in the three cavities 205 of the T-shaped ribs 21, and with the pair of resilient pads 42 abutting against the grounding bar 82 of the coaxial cable subassembly 80. The insert 20, together with the plurality of contacts 30, the grounding plate 40 and the coaxial cable subassembly 80, is assembled to the insulating housing 10. The step-shaped side walls 24 of the insert 20 engage with the arms 13 and the contacting portions 301 of the contacts 30 are received in corresponding passageways 101. Finally, the shield 50 covers the housing 10 from a rear end thereof, whereby the pair of fingers 54 of the shield 50 abut against rear sides of the blocks 121 of the housing 10, and the cutouts 502 and rectangular holes 503 engage with the protrusions 131 of the housing 10, respectively, so as to fixedly assemble the shield 50 on the housing 10. The free ends 531 of the two L-shaped tabs 53 of the shield 50 project rearwardly to contact with the resilient pads 42 so that a grounding path is established from the metal braiding 811 to the shield 50 through the grounding bar 82 and the grounding plate 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable connector assembly comprising:

a coaxial cable subassembly having a plurality of wires and a grounding bar, each wire having a core conductor and a metal braiding electrically contacting with the grounding bar; and an electrical cable connector comprising:

an insulating housing comprising a main body defining a plurality of passageways, and a receiving space at a rear end thereof in communication with the passageways;

an insert received in the receiving space of the insulating housing, the insert defining an elongated slot receiving the grounding bar of the coaxial cable subassembly therein;

a plurality of contacts received in the insert contacting with core conductors, respectively;

a conductive grounding plate received in the receiving space of the insulating housing and engaged with the insert, the grounding plate having a resilient pad contacting with the grounding bar; and a shield enclosing the insulating housing, the shield having an upper plate engaged with a rear side of the insulating housing, an opposite lower plate and a pair of opposite side plates, the upper plate having a tab electrically contacting with the resilient pad of the grounding plate; wherein the insulating housing has a tongue portion extending rearwardly from the main body, and the grounding plate comprises a rectangular portion sandwiched between the tongue portion and the insert; wherein the insert comprises a row of T-shaped ribs and a row of protrusions formed on an upper side thereof, each T-shaped rib aligning with a corresponding protrusion.

2. A The electrical cable connector assembly as described in claim 1, wherein the insert defines a cavity in a selected T-shaped rib, and wherein the grounding plate comprises a claw engaged with the cavity.

3. The electrical cable connector assembly as described in claim 2, wherein the insert forms a plurality of embossments projecting from the upper side thereof, and wherein the insulating housing defines a plurality of notches receiving corresponding embossments.

4. The electrical cable connector assembly as described in claim 2, wherein the insert defines a plurality of receiving channels between adjacent T-shaped ribs receiving corresponding contacts and core conductors therein, the receiving channels communicating with the elongated slot.

5. The electrical cable connector assembly as described in claim 4, wherein each contact has a contacting portion received in the passageway of the housing and a soldering portion received in a corresponding receiving channel of the insert for soldering with the core conductor of the wire.

6. The electrical cable connector assembly as described in claim 5, wherein the upper plate of the shield forms a pair of forwardly extending fingers, and wherein the insulating housing forms a pair of blocks on opposite ends thereof engaging with corresponding fingers.

7. The electrical cable connector assembly as described in claim 6, wherein each side plate of the shield defines a cutout and a rectangular hole, and wherein the insulating housing forms a pair of protrusions on each opposite end thereof received in corresponding cutout and rectangular hole.

8. An electrical cable connector assembly for mating with a mating connector, comprising:

a coaxial cable subassembly comprising a plurality of wires, each wire having a length of exposed core conductor and a length of bared metal braiding, and a grounding bar electrically contacting the metal braidings of the wires;

an insulating housing defining a plurality of passageways and a receiving space communicating with the passageways;

an insert received in the receiving space of the insulating housing, the insert defining an elongated slot receiving the grounding bar, and a plurality of ribs, and a plurality of engaging portions formed on selected ribs;

a plurality of contacts accommodated in the insert;

a conductive shield enclosing the insulating housing, the shield comprising an upper plate having a plurality of resilient tabs projecting rearwardly from a front edge thereof; and a grounding plate comprising a plurality of retaining portions engaged with corresponding engaging portions of the insert, and a plurality of rearwardly extending resilient pads sandwiched between the grounding bar and the resilient tabs of the shield; wherein the retaining portions of the grounding plate are configured as downwardly extending claws from a rear edge thereof, and wherein the engaging portions of the insert are configured as cavities receiving corresponding claws; wherein the resilient tabs of the shield is configured as L-shaped tabs, each tab having a free end extending rearwards.

9. The electrical cable connector assembly as described in claim 8, wherein the insert comprises a row of ribs on a top side thereof, a row of ribs defining a plurality of channels therebetween in communication with the elongated slot for receiving the contacts.

10. An electrical cable connector assembly comprising:

a coaxial cable assembly including a plurality of wires, each of said wires defining an exposed inner conductor and a bared metal braiding, a grounding bar extending along a lengthwise direction of the housing and mechanically and electrically engaged with the metal braidings of said wires;

an insulating housing defining therein a plurality of passageways extending in a front-to-back direction perpendicular to said lengthwise direction, and a rearwardly extending tongue portion with thereunder a receiving space communicating with the passageways;

an insert received within the receiving space and receiving said grounding bar therein;

a plurality of contacts accommodated in the insert, respectively received within the corresponding passageways, and respectively mechanically and electrically engaged with the inner conductors of the corresponding wires, respectively;

a grounding plate extending along said lengthwise direction and having a rectangular portion sandwiched between the tongue portion and the insert in a vertical direction perpendicular to both said lengthwise direction and said front-to-back direction, and mechanically and electrically engaged with said grounding bar; and a conductive shell enclosing a part of said insert, and mechanically and electrically engaged with said grounding plate; wherein the insert comprises a rows of T-shaped ribs and a row of protrusions formed on an upper side thereof, each T-shaped rib aligning with a corresponding protrusion.

11. The assembly as described in claim 10, wherein said housing shields only one side of the insert.

12. The assembly as described in claim 10, wherein said shell shields the other side of the insert opposite to said side in said vertical direction.

* * * * *